US008769727B1

(12) United States Patent
Hester

(10) Patent No.: US 8,769,727 B1
(45) Date of Patent: Jul. 8, 2014

(54) TEMPLE PROTECTION DEVICE FOR BASEBALL PITCHERS

(76) Inventor: John Dennis Hester, Houston, TX (US)

( * ) Notice: Subject to any disclaimer, the term of this patent is extended or adjusted under 35 U.S.C. 154(b) by 631 days.

(21) Appl. No.: 12/930,816

(22) Filed: Jan. 18, 2011

(51) Int. Cl.
*A42B 1/24* (2006.01)

(52) U.S. Cl.
USPC ..... 2/422; 2/425

(58) Field of Classification Search
USPC ..... 2/455, 410, 6.3–6.5, 422, 423, 15, 10, 2/448, 449, 450, 451, 452, 453, 454
See application file for complete search history.

(56) References Cited

U.S. PATENT DOCUMENTS

| | | | | | |
|---|---|---|---|---|---|
| 2,214,748 | A | * | 9/1940 | Mauro | 2/423 |
| 2,391,335 | A | | 12/1945 | O'Brien | |
| 2,753,561 | A | | 7/1956 | Mauro | |
| 2,861,270 | A | * | 11/1958 | McCoy | 2/423 |
| 3,373,444 | A | * | 3/1968 | Militello | 2/10 |
| 4,432,100 | A | * | 2/1984 | Bates | 2/424 |
| 5,052,054 | A | * | 10/1991 | Birum | 2/10 |
| 5,121,507 | A | * | 6/1992 | Brown | 2/172 |
| 5,125,113 | A | * | 6/1992 | Yun | 2/10 |
| 5,269,026 | A | | 12/1993 | McManus | |
| 5,313,668 | A | | 5/1994 | Bogan | |
| 5,437,064 | A | | 8/1995 | Hamaguchi | |
| 5,481,759 | A | | 1/1996 | Rinaldi | |
| 5,493,733 | A | * | 2/1996 | Pospisil | 2/195.1 |
| 6,237,147 | B1 | * | 5/2001 | Brockman | 2/10 |
| 6,286,149 | B1 | * | 9/2001 | Whitaker | 2/209 |
| 6,550,064 | B2 | * | 4/2003 | Schmitt et al. | 2/10 |
| 7,096,512 | B2 | | 8/2006 | Blair | |
| 7,325,920 | B1 | * | 2/2008 | Gelfuso | 351/155 |
| 8,042,198 | B1 | * | 10/2011 | Cleveland | 2/411 |
| 8,060,950 | B1 | * | 11/2011 | Thornton | 2/209 |
| 8,091,150 | B2 | * | 1/2012 | Bengochea | 2/425 |
| 8,286,269 | B2 | * | 10/2012 | Springer et al. | 2/422 |
| 8,381,359 | B1 | * | 2/2013 | McArdle | 24/3.12 |
| 8,418,271 | B2 | * | 4/2013 | Hardy | 2/423 |
| 2004/0214147 | A1 | * | 10/2004 | Robinson | 434/247 |
| 2007/0109492 | A1 | * | 5/2007 | Abraham | 351/45 |
| 2009/0049586 | A1 | * | 2/2009 | Wirthenstaetter | 2/423 |
| 2009/0126062 | A1 | * | 5/2009 | Bengochea | 2/10 |
| 2009/0235437 | A1 | * | 9/2009 | Springer et al. | 2/422 |
| 2009/0290120 | A1 | * | 11/2009 | Abraham et al. | 351/158 |
| 2009/0300827 | A1 | * | 12/2009 | Mizuno | 2/423 |
| 2010/0154093 | A1 | * | 6/2010 | Provost et al. | 2/10 |
| 2011/0247120 | A1 | * | 10/2011 | Knoedler | 2/10 |

* cited by examiner

*Primary Examiner* — Danny Worrell

(57) ABSTRACT

One embodiment of a temple protection device that is designed to be worn underneath the wearer's hat or baseball cap. The device has a two-sided hard plate shell (18) comprised of rigid protective material. One side of the device has a clamp (22) that is used to attach the temple protection device to the sweat band of the wearer's cap. The opposite side of the temple protection device fits against the wearer's head and may have padding (26, 28, 30) attached thereto. At the base of the hard plate shell (18) there is a temple protection flap (20) that protrudes from under the wearer's cap to cover temple area that is not under the wearer's cap. Other embodiments are described as shown.

8 Claims, 5 Drawing Sheets

TEMPLE PROTECTION DEVICE FOR BASEBALL PITCHERS

FIELD OF THE INVENTION

This invention pertains to the art of head protection devices, more particularly to protective inserts and liners to be worn under the wearer's hat or cap.

BACKGROUND

Description of Prior Art

In the sport of baseball, pitchers are highly vulnerable to being struck by the ball. Of the eight players on the field that are positioned in front of the hitter, the pitcher is closest. In little league baseball the pitcher is positioned only 46 feet from the hitter, and in other levels of play the pitcher is positioned 60 feet, 6 inches from the hitter. Often times, therefore, when the hitter strikes the ball and it immediately returns to the pitcher, there is too little time for the pitcher to react, and the pitcher is struck by the ball. This is especially problematic when the pitcher is struck by the ball in the head. Furthermore, because of the common follow-through of the pitching motion, pitchers often end their throwing motion with the side of their head that corresponds to their throwing arm fully exposed to being struck by the ball. Therefore, frequently when pitchers are struck on the head, they are hit in the temple area. An injury from such an impact can be severe, if not life threatening.

Currently, there is no device that fully yet inconspicuously protects the temple-region of a baseball pitcher's head. And pitchers from the major league to the little league level typically do not wear any head protection. Much of the protective headgear currently available is inadequate for baseball pitchers because it (1) does not adequately protect the full temple region; (2) does not fit securely enough to the head to avoid movement during the pitching motion; and/or (3) is too bulky, noticeable, and uncomfortable.

A number of examples of known head protectors will now be discussed. U.S. Pat. No. 5,481,759 to Rinaldi, et al., provides a combination expandable hat and rigid shell for protection of the head. The expandable hat is designed to securely fit around the rigid shell, which shell is to be worn on the head. The shell is bulky and offers no protection to the temple area that is not covered by the expandable hat.

U.S. Pat. No. 7,096,512 to Blair, provides a protective liner insert device to be worn under a cap. The insert device fits under the wearer's cap and covers the entirety of the head that is covered by the wearer's cap. This device offers no protection to the temple area that is not covered by the wearer's cap.

U.S. Pat. No. 5,269,026 to McManus, provides a protective liner insert device to be worn under a cap, and the liner partially encircles the head. The device offers no protection to the temple area that is not covered by the wearer's cap.

U.S. Pat. No. 2,391,335 to O'Brien, provides a head protector that is comprised of a hardened shell that wraps completely around the head. The protector completely covers the temples and has recesses for the ears. The device is meant to be worn under the wearer's cap but is bulky because it encircles the entirety of the wearer's head. The device also has no means of being secured or fastened to the wearer's cap.

U.S. Pat. No. 2,753,561 to Mauro, provides a head protector for baseball players that fits on the head, outside the player's cap. The protector is bulky and is strapped to the wearer's head outside of the wearer's cap.

Therefore, there is a present need for a secure, comfortable, and inconspicuous device that protects the temple region of a baseball pitcher's head. The present invention provides full protection to the temple region of one side of the head, and comfortably and securely fits to the head under the wearer's baseball cap. The present invention, furthermore, is less bulky and less conspicuous than prior art. This is because it covers only a small portion of the wearer's head on only one side of the head. This is especially useful to pitchers in the game of baseball because the follow-through of the common pitching motion generally leaves the temple region of the throwing-arm side of the pitcher's head vulnerable to being struck by the ball, while the other side of the pitcher's head faces (safely) away from the hitter. Temple protection for the side of the head that is opposite the throwing arm side, therefore, is of little—if any—necessity. Similarly, baseball hitters typically wear a protective covering for their ear and temple area on only the side of their head that faces the pitcher—and is therefore vulnerable to being struck by the ball—while the other ear and temple area are fully exposed. Thus, prior art that protects both sides of the head will be much less desirable to a pitcher in the game of baseball. Finally, the present invention, in comparison with prior art, much less dramatically changes the player's appearance while protecting the necessary temple area. This is important because baseball is a sport that is firmly rooted in tradition, and variation from that tradition is usually strongly opposed by fans and players.

SUMMARY

The present invention relates to a temple protection device that protects the temple area of one side of the wearer's head. The invention is designed to fit underneath of the wearer's baseball cap, between the cap and the temple region of the wearer's head. A hard plate shell substantially covers the wearer's temple region, underneath of the wearer's cap. At the base of the wearer's cap, in front of the wearer's ear, a protective flap protrudes slightly from under the wearer's cap to cover the temple region that is exposed outside of the cap.

The hard plate shell is held in place by the natural pressure provided by the wearer's cap against the wearer's head, and by a clamp device that is attached to the hard plate shell. The clamp device is designed to attach onto the inner sweat band of the wearer's baseball cap by sandwiching the inner sweat band between the clamp device and the hard plate shell. The top of the clamp device is connected to the hard plate shell at a shelf protruding from the top of the clamp device. The clamp device extends downward along side of the hard plate shell and stops near the base of the hard plate shell. There is a small gap between the clamp device and the hard plate shell. The gap is spaced to permit the inner sweat band of the wearer's baseball cap to slide inside of the gap; in between the clamp device and the hard plate shell. When the inner sweat band is slid in between the clamp device and the hard plate shell, the temple protection device fits securely to the side interior of the wearer's cap, and protects the wearer's temple area from the impact of a projectile.

The hard plate shell and temple protection flap is lined with interior padding, which fits against the wearer's head and provides increased protection.

In an alternate embodiment, the thickness of the hard plate shell tapers up slightly from the bottom to the top of the hard plate shell, thereby creating a slope that thickens slightly as it goes down the side of the wearer's head. This downward slope makes the hard plate shell fit more comfortably to the wearer's head inside of the wearer's cap; provides increased protection to the lower temple area narrows the gap between the clamp device and the hard plate shell thereby making the grip on the inner sweat band more secure; and directs a projectile upward after contact with the temple protection device.

In an alternate embodiment, the clamp device is attached to the hard plate shell at a hinge. In this embodiment, the top of the clamp device is fastened to a hinge pin that is secured to the hard plate shell by two lifts protruding from the hard plate shell. When the clamp device is fastened to the hinge pin, a hinge is formed and the clamp device has the ability to flip up and down. When the clamp device is lowered onto the interior sweat band of a baseball cap, it pinches the sweat band between the clamp device and the hard plate shell. In this embodiment, a strap may be provided for securing the clamp device against the inner sweat band. The strap is secured to the exterior of the clamp device by an adhesive or other appropriate material. On either end of the underside of the strap is a hook and loop fastening material such as Velcro®. The opposite hook and loop fastening material is located on two pads on the hard plate shell. These pads are positioned so that when the clamp device is lowered onto the sweatband, the hook and loop fastening material on either end of the strap lines up with an opposite hook and loop fastening material on the hard plate shell. When the clamp device is lowered onto the interior sweat band, the strap attached to the clamp device can be fastened to the hard plate shell by pressing the hook and loop fastening material on the strap against the opposite hook and loop fastening material on the hard plate shell.

BRIEF DESCRIPTION OF DRAWINGS

Figures

These and other features, aspects, and advantages of the present invention will become better understood with regard to the following description and accompanying drawings, wherein.

DETAILED DESCRIPTION

Figure 1:
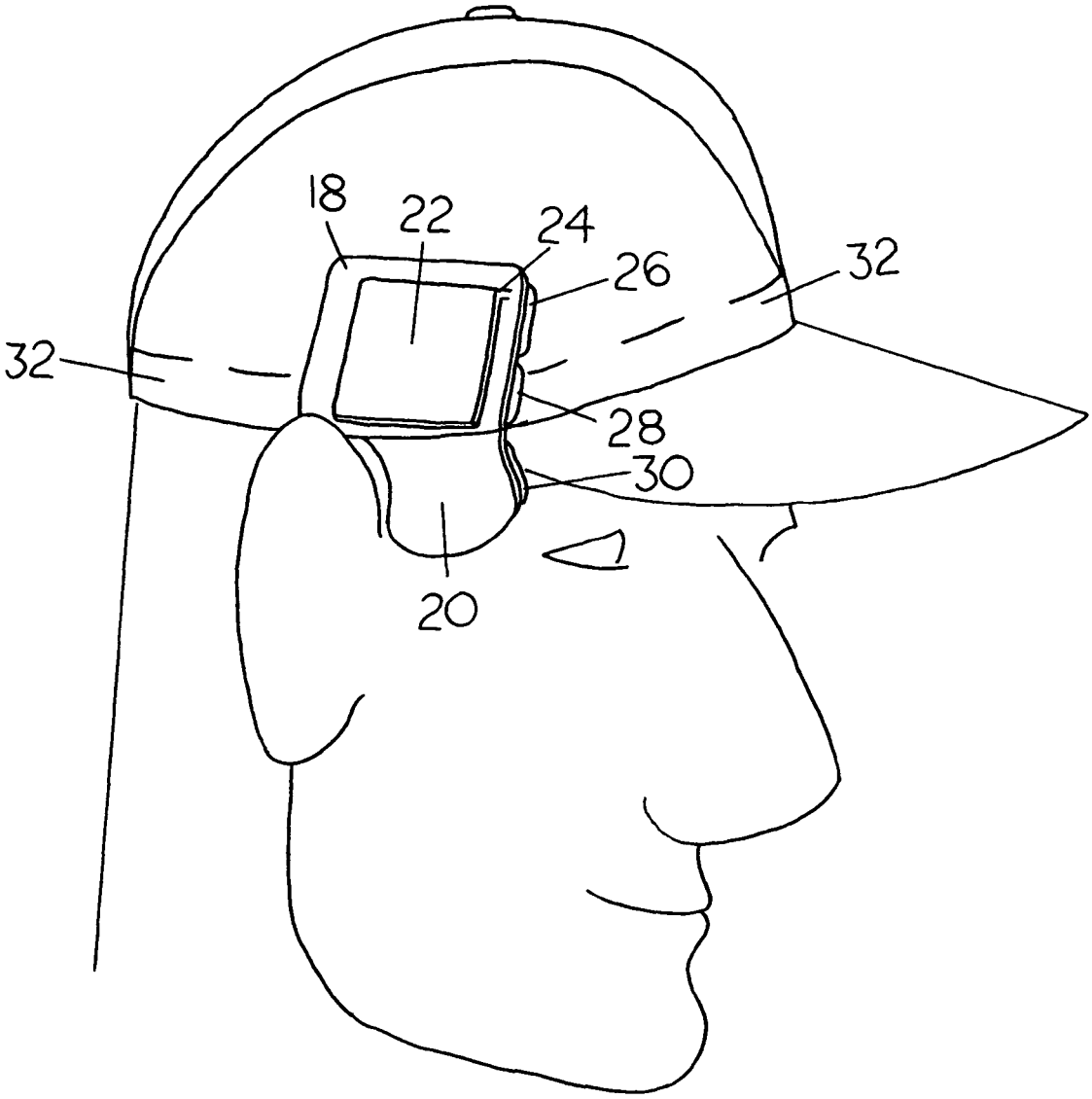
FIG. 1 shows a perspective view of this invention with interior padding positioned under the wearer's baseball cap.

In FIG. 1 a temple protection device is shown to generally include: a hard plate shell 18, a temple protection flap 20, a clamp device 22, and a shelf 24. FIG. 1 also shows interior pads which may be provided; including, a top inner pad 26, a middle inner pad 28, and an inner pad for the temple protection flap 30. The temple protection device's utility is to protect the temple region on one side of the wearer's head. The drawing provides a view of the temple protection device inside of the wearer's baseball cap to better understand the placement of the device. The individual pictured throws right handed; therefore, the temple protection device fits under the right side of the individual's baseball cap. It will be apparent that a left handed thrower would require a temple protection device that fits under the left side of the individual's baseball cap and such arrangement would be the mirror image of the one pictured in FIG. 1.

Figure 2:
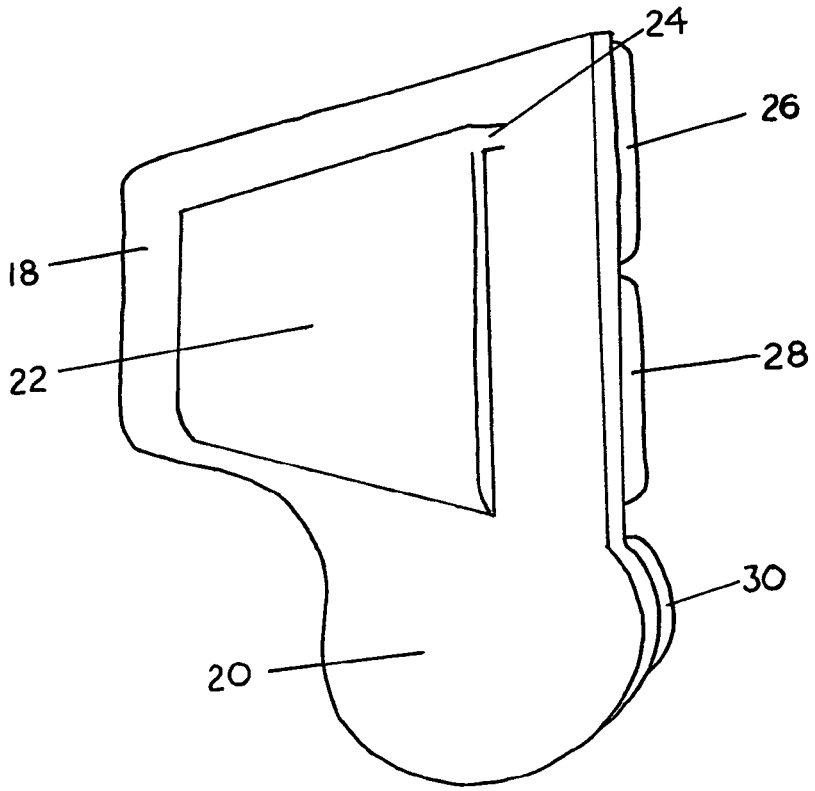
FIG. 2 shows a perspective view of this invention with interior padding.
Figure 3:
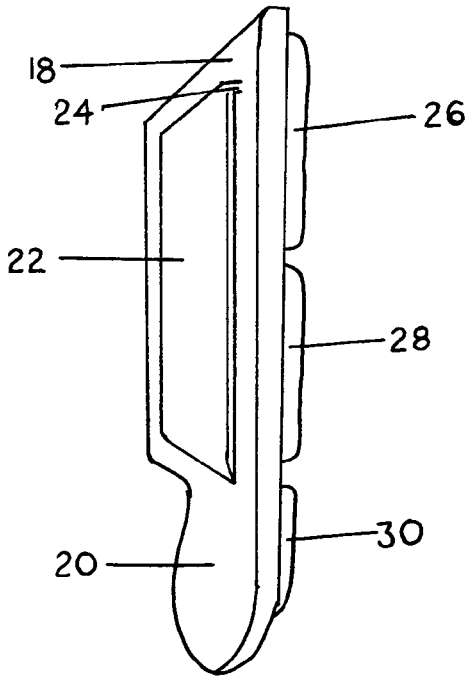
FIG. 3 shows a perspective view of this invention with interior padding.

Referring to FIG. 1, FIG. 2, and FIG. 3, the temple protection device is partly comprised of a hard plate shell 18, which, when the temple protection device is worn, substantially covers the temple area of the wearer's head underneath the wearer's baseball cap. A temple protection flap 20 protrudes from underneath the wearer's baseball cap in front of the ear to cover the wearer's temple area that is not covered by the baseball cap. The hard plate shell 18 and temple protection flap 20 are comprised of rigid, typically a lightweight, impact-resilient polycarbonate-like, composite fiberglass weave, or carbon fiber material sufficient to protect the skull, head, or temple or any combination thereof from the impact of a fast-moving hard projectile such as a baseball. The hard plate shell 18 is secured to the side of the wearer's head by the natural pressure provided by the wearer's cap against the wearer's head, and by the clamp device 22, which is used to fasten the temple protection device to the inner sweat band 32 of the wearer's cap. The clamp device 22 is also comprised of rigid material, typically a lightweight, impact-resilient polycarbonate-like material. The top of the clamp device 22 is connected, attached with an appropriate adhesive, or fused to the hard plate shell 18, at a shelf 24 protruding from the top of the clamp device 22, which bridges the clamp device 22 to the hard plate shell 18. When the clamp device 22 is attached to the hard plate shell 18, the clamp device 22 extends down the hard plate shell 18 from the shelf 24, and stops near the base of the hard plate shell 18. There is a slight gap between the hard plate shell 18 and the clamp device 22, so that the temple protection device can be fastened to the inner sweat band 32 of the wearer's cap by sliding the inner sweat band 32, in between the clamp device 22 and the hard plate shell 18. The inner sweatband 32, is typically a part of existing baseball caps and forms a convenient anchor for fastening the temple protection device to the interior of the wearer's baseball cap.

FIG. 1 illustrates that the temple protection device is worn by fastening it to the inner sweat band 32 of a baseball cap. The inner sweat band 32 of the wearer's cap is sandwiched in between the clamp device 22 and the hard plate shell 18. This secures the sweatband 32 between the clamp device 22 and the hard plate shell 18.

Figure 6:
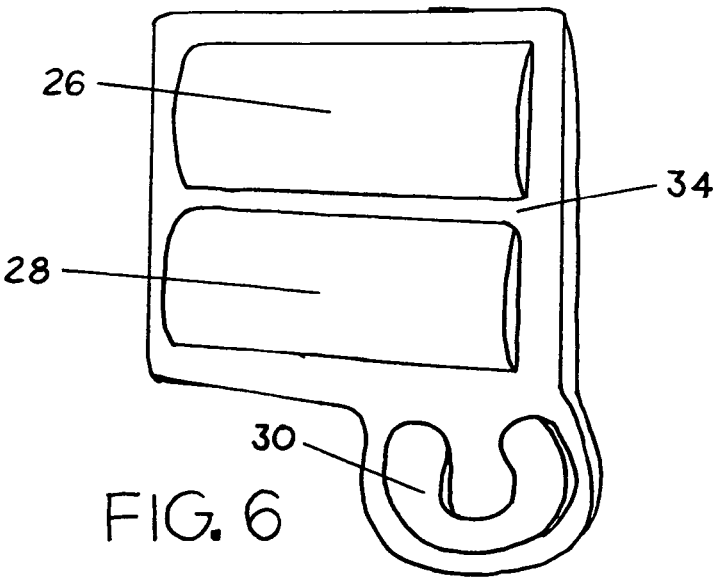
FIG. 6 shows a perspective view of this invention with interior padding.

FIG. 1, FIG. 2, and FIG. 3, all show the temple protection device with interior padding, 26, 28, 30. The interior padding is further shown in FIG. 6, which illustrates the inner surface of the hard plate shell 34, with padding 26, 28, 30, attached thereto. The padding 26, 28, 30 is attached with an appropriate adhesive and provides increased protection to the wearer's head. The inner padding may be comprised of three pads, a top pad 26, middle pad 28, and lower pad 30; however, it will be obvious to anyone skilled in the art that the amount, placement, and arrangement of the pads may vary. For example, the top two pads, 26 and 28, may be replaced with one pad that substantially covers the full interior surface of the hard plate shell 18. Or, one pad may line the full interior surface of the temple protection device; including both the hard plate shell 18 and temple protection flap 20. The pad or pads are comprised of a single or multiple layer of suitable material that reduces impact force.

Figure 4:
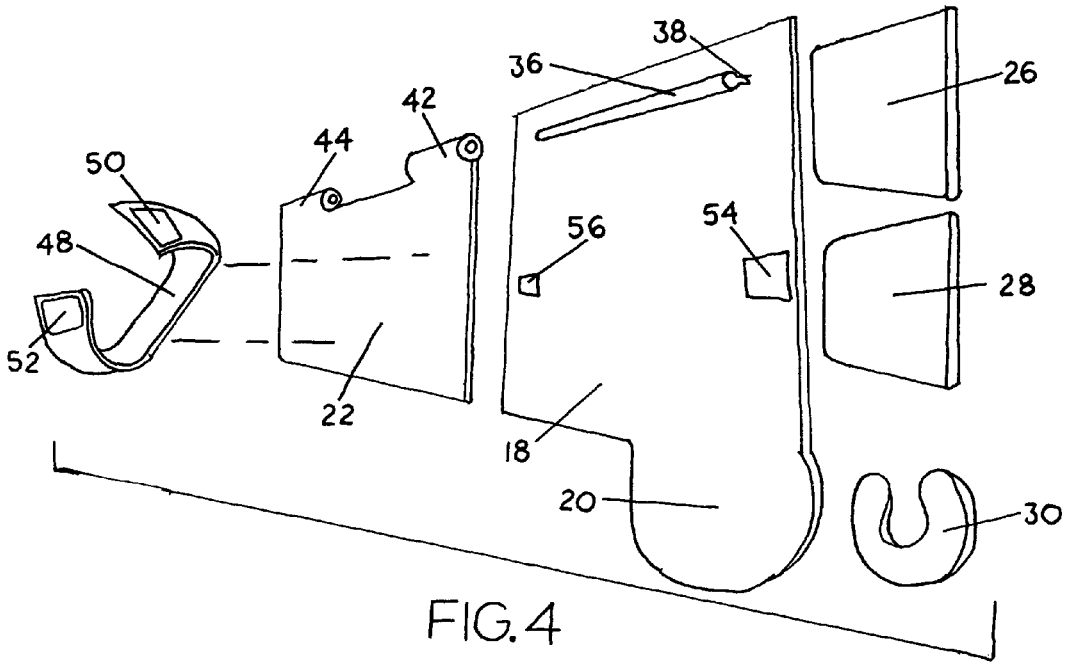
FIG. 4 shows an exploded perspective view of an alternate embodiment of this invention with interior padding.
Figure 4A:
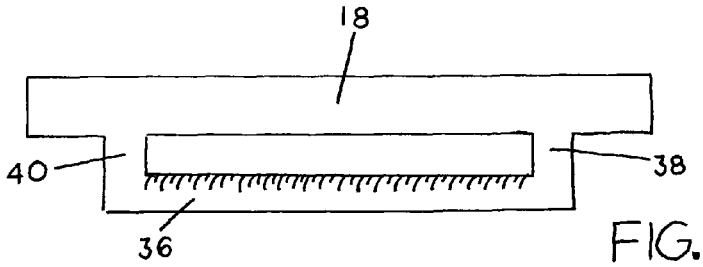
FIG. 4A is a top side view of the embodiment illustrated in FIG. 4.

Referring to FIG. 4, in another embodiment of the temple protection device, the clamp device 22 is connected to the hard plate shell 18 at a hinge pin 36. In this embodiment, the clamp device 22 is pivotally connected to the hard plate shell 18, at a hinge pin 36, which rises slightly off of the surface of the hard plate shell, due to lifts 38, 40, on either end of the hinge pin 36, as shown in FIG. 4A. FIG. 4A is a top side view of the hard plate shell 18; lifts 38, 40; and hinge pin 36. The gap between the hinge pin 36 and the hard plate shell 18 provides a space for the joints 42, 44, at the top of the clamp device 22, to encircle the hinge pin 36, as shown in FIG. 4B, which is a top side view of the hard plate shell 18; lifts 38, 40; hinge pin 36; joints 42, 44; and camp device 22.

Figure 4B:
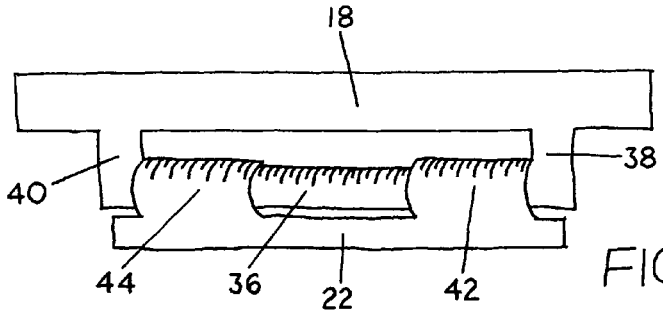
FIG. 4B is a top side view of the embodiment illustrated in FIG. 4.
Figure 5:
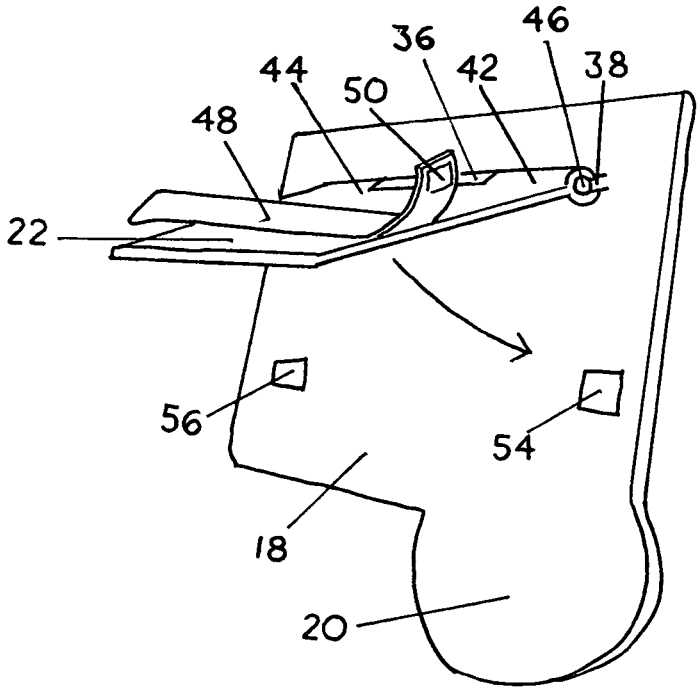
FIG. 5 shows a perspective view of the embodiment illustrated in FIG. 4.

As shown in FIG. 4B and FIG. 5, when the joints 42, 44 are locked onto the hinge pin 36, a complete hinge point 46 is formed and the clamp device 22 is capable of performing an up and down flipping motion, as illustrated in FIG. 5.

As further shown in FIG. 4 and FIG. 5, interior padding 26, 28, 30, may be provided with this embodiment.

As further shown in FIG. 4 and FIG. 5, a strap 48 may be affixed to the clamp device 22 for the purpose of better securing the clamp device 22 against the inner sweat band and the hard plate shell 18. The strap 48 is affixed to the clamp device 22 by adhesive or other appropriate material. On the underside of the strap 48, there is a pad on the right side 50 with hook and loop fastening material such as Velcro®, and a pad on the left side 52, also with hook and loop fastening material such as Velcro®. On either side of the hard plate shell, there are pads 54, 56, with the opposite hook and loop fastening material to that of the pads on the underside of the strap 50, 52. Once the clamp device 22 is lowered onto the inner sweatband of the cap, the pads on the underside of the strap 50, 52, line up with the corresponding pads on the hard plate shell, 54, 56. Therefore, the strap 48, may be fastened to the hard plate shell 18 by pressing the ends of the strap with hook and loop fastening material 50, 52, against the pads with the opposite hook and loop fastening material 54, 56, that are located on the hard plate shell 18.

Figure 7:
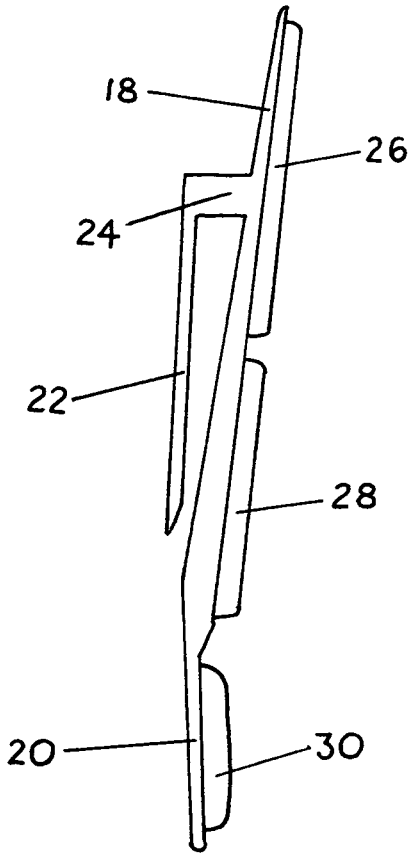
FIG. 7 shows a side view of an alternate embodiment of this invention with interior padding.

With reference to FIG. 7, another embodiment of the hard plate shell 18 of the present invention will be described. In this embodiment, the thickness of the hard plate shell 18 tapers up slightly from the bottom to the top. This creates a downward slope, which substantially conforms to the shape of the wearer's cap; fits comfortably to the wearer's head inside of the wearer's cap; provides increased protection to the lower temple area and directs a projectile—such as a baseball—upward after contact with the device. The downward slope also narrows the gap between the clamp device 22 and the hard plate shell 18, thereby allowing the clamp device 22 to more securely press the inner sweat band of the wearer's cap against the hard plate shell 18.

As further shown in FIG. 7, interior padding 26, 28, 30, may be provided with this embodiment.

It should be understood that the foregoing description is only illustrative of the invention. Various alternatives and modifications can be devised by those skilled in the art without departing from the spirit or scope of the invention as described. Accordingly, the present invention is intended to embrace all such alternatives, modifications, and variances which fall within the scope of the appended claims.

I claim:

1. A temple protection device comprising:

(a) a hard plate shell comprised of rigid material adapted to protect a wearer of said temple protection device from damage to the skull, head or temple areas or any combination thereof from impact forces to be worn underneath the wearer's baseball cap, and of sufficient size to substantially cover the temple area of the wearer that is covered by the wearer's cap;

(b) a temple protector flap comprised of rigid material adapted to protect a wearer of said temple protection device from damage to the skull, head or temple areas or any combination thereof from impact forces that is connected to said hard plate shell and which protrudes from underneath the wearer's cap to substantially cover the wearer's temple area that is not covered by the wearer's cap;

(c) a clamp device that is connected to said hard plate shell, which is designed to secure said hard plate shell to the inner sweat band of the wearer's baseball cap by sandwiching the inner sweat band of the cap between said clamp device and said hard plate shell;

(d) inner padding affixed to the interior of said hard plate shell and temple protector flap to provide a comfortable fit for the wearer and to offer further protection to the wearer from damage to the skull, head or temple areas or any combination thereof of from impact forces;

whereby said temple protection device can be worn on the side of a wearer's head, under the wearer's cap.

2. A temple protection device of claim 1, wherein said hard plate shell includes an upward taper in thickness that substantially conforms to the shape of the wearer's cap.

3. A temple protection device of claim 1, wherein said clamp device is connected to said hard plate shell at a hinge so that said clamp device is capable of performing an up and down flipping motion.

4. A temple protection device of claim 3, wherein:

(a) said clamp device includes a strap that lays across said clamp device, said strap has a right and left side which protrude from the outer edges of said clamp device, said strap contains a hook and loop fastening material on the underside of the right and left side of said strap that protrude from the outer edges of said clamp device; and (b) said hard plate shell includes two pads affixed to said hard plate shell's partial surface with the opposite type of hook and loop fastening material to that on said strap.

5. A temple protection device comprising:

(a) a hard plate shell comprised of rigid material adapted to protect a wearer of said temple protection device from damage to the skull, head or temple areas or any combination thereof from impact forces to be worn underneath the wearer's baseball cap, and of sufficient size to substantially cover the temple area of the wearer that is covered by the wearer's cap;

(b) a temple protector flap comprised of rigid material adapted to protect a wearer of said temple protection device from damage to the skull, head or temple areas or any combination thereof of from impact forces that is connected to said hard plate shell and which protrudes from underneath the wearer's cap to substantially cover the wearer's temple area that is not covered by the wearer's cap;

(c) a clamp device that is connected to said hard plate shell at a hinge so that said clamp device is capable of performing an up and down flipping motion, said clamp device is designed to secure said hard plate shell to the inner sweat band of the wearer's baseball cap by sandwiching the inner sweat band of the cap between said clamp device and said hard plate shell;

whereby said temple protection device can be worn on the side of a wearer's head, under the wearer's cap.

6. A temple protection device of claim 5, wherein padding is affixed to the interior of said temple protection device.

7. A temple protection device of claim 5, wherein:

(a) said clamp device includes a strap that lays across said clamp device, said strap has a right and left side which protrude from the outer edges of said clamp device, said strap contains a hook and loop fastening material on the underside of the right and left side of said strap that protrude from the outer edges of said clamp device; and (b) said hard plate shell includes two pads affixed to said hard plate shell's partial surface with the opposite type of hook and loop fastening material to that on said strap.

8. A temple protection device of claim 7, wherein padding is affixed to the interior of said temple protection device.

* * * * *